US007160005B1

(12) United States Patent
Pape et al.

(10) Patent No.: US 7,160,005 B1
(45) Date of Patent: Jan. 9, 2007

(54) LAMP DISPLAY SYSTEM

(75) Inventors: Robert J. Pape, Ponte Vedra Beach, FL (US); David M. Lasch, Jacksonville, FL (US); Todd R. Langner, Solon, OH (US); Curtis N. Lagman, Jacksonville, FL (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 11/325,152

(22) Filed: Jan. 4, 2006

Related U.S. Application Data

(60) Provisional application No. 60/642,001, filed on Jan. 7, 2005.

(51) Int. Cl.

| | |
|---|---|
| ***F21V 11/00*** | (2006.01) |
| ***F21V 8/08*** | (2006.01) |
| ***B60Q 1/00*** | (2006.01) |
| ***A47F 7/00*** | (2006.01) |

(52) U.S. Cl. ..... 362/351; 362/370; 362/418; 211/85.14

(58) Field of Classification Search ..... 362/351, 362/370, 418; 248/176.1, 177.1; 211/85.14
See application file for complete search history.

(56) References Cited

U.S. PATENT DOCUMENTS

| | | | | |
|---|---|---|---|---|
| 5,996,819 | A * | 12/1999 | Klein | 211/85.14 |
| 6,182,841 | B1 * | 2/2001 | Klein | 211/85.14 |
| 6,591,993 | B1 * | 7/2003 | Humphrey | 211/85.14 |
| 7,001,050 | B1 * | 2/2006 | Beasley et al. | 362/414 |

* cited by examiner

*Primary Examiner*—Renee Luebke
*Assistant Examiner*—Evan Dzierzynski
(74) *Attorney, Agent, or Firm*—Baker Donelson

(57) ABSTRACT

A lamp display system (10) is disclosed for displaying various lamp shades (11) with various lamps (12). The lamp display system includes a rear wall (13), a top shelf (14), a middle shelf (15), and a bottom shelf (16). The system also includes a plurality of lamp shade mounting arms (18). Each mounting arm has an arm portion (19) extending to a light bulb socket (21), and a harp (22). Each mounting arm may be mounted to an elongated mounting bracket (23) which in turn is mounted to the rear wall. The mounting arms are also staggered in height and/or distance from the rear wall to allow for the compact display of many lamp shades.

14 Claims, 3 Drawing Sheets

LAMP DISPLAY SYSTEM

REFERENCE TO RELATED APPLICATION

This is a continuation-in-part of U.S. Patent Application Ser. No. 60/642,001 filed Jan. 7, 2005.

TECHNICAL FIELD

This invention relates generally to displays, and more particularly to displays for lamps and lamp shades.

BACKGROUND OF THE INVENTION

Table lamps typically have a base, a harp mounted to the top of the base, a light socket, and a light shade mounted to the top of the harp. The base may be made in a vast number of different shapes, configurations, colors, textures, and materials. Similarly, the lamp shades may be made in a vast number of different shapes, colors, textures and materials.

In today's market, lamps are often sold at the retail level with each base having a preselected shade. However, with more expensive or select lamps the lamp base is oftentimes sold separately from the lamp shade. Here, a customer may choose from a variety of lamp shades to be associated with the selected base. The customer typically selects the lamp shade by mounting several lamp shades to the base in succession until the desired shade is selected based on its appearance in conjunction with the base. In accomplishing this task, the customer must mount each lamp shade to the top of the harp then tighten a finial to secure the shade to the harp. This task of mounting several shades is tedious and time consuming. Furthermore, as lamp shades come in a variety of different sizes, one must oftentimes change the size of the harp so that the lamp shade is positioned a proper distance from the base. The constant changing of the harp is also tedious and time consuming for the customer.

Accordingly, it is seen that a need remains for a device to allow different lamp shades to be displayed with a lamp base in a quick and efficient manner. It is to the provision of such therefore that the present invention is primarily directed.

DETAILED DESCRIPTION

Figure 1:
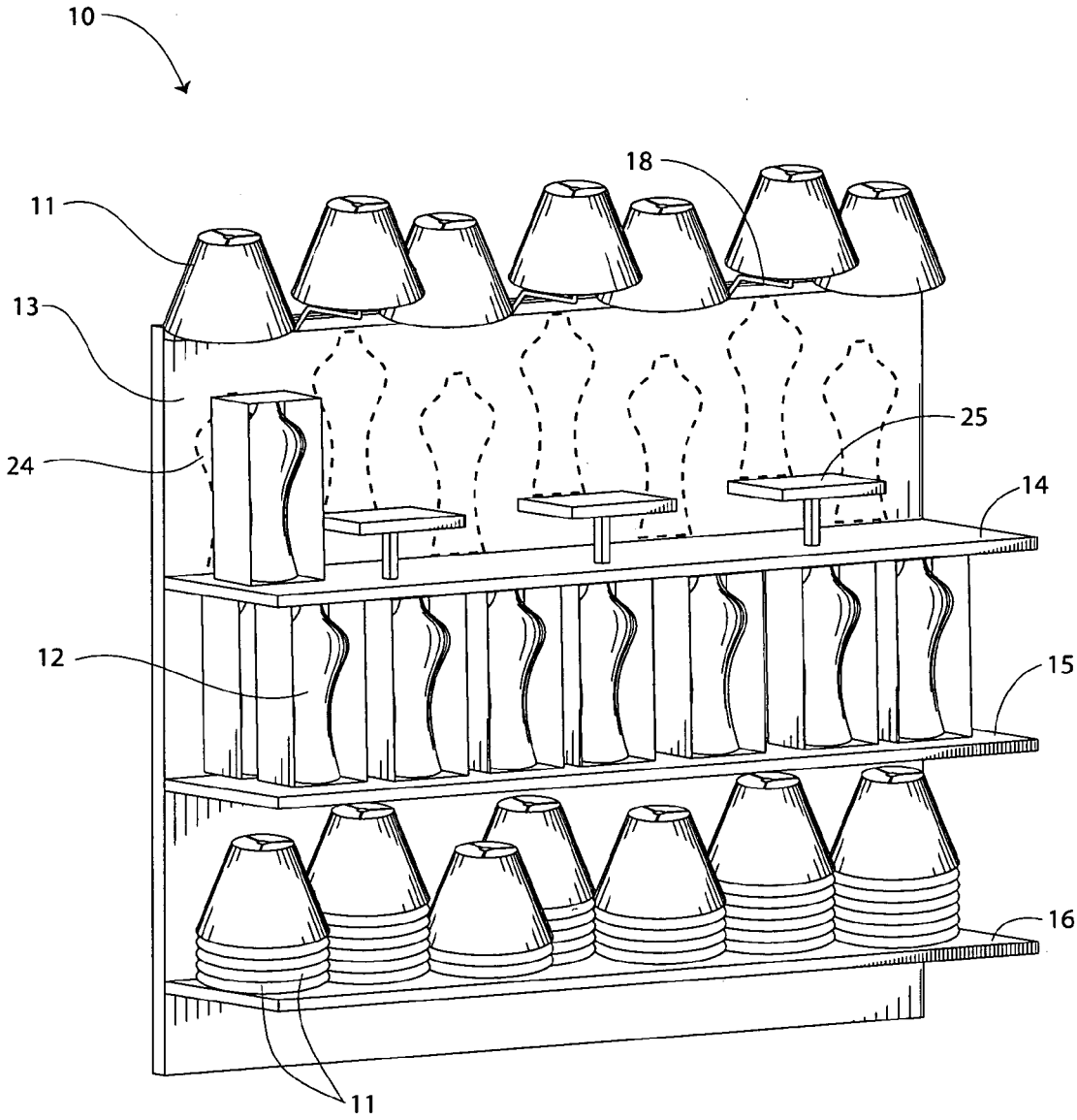
FIG. 1 is a perspective view of the lamp display system of the present invention.
Figure 2:
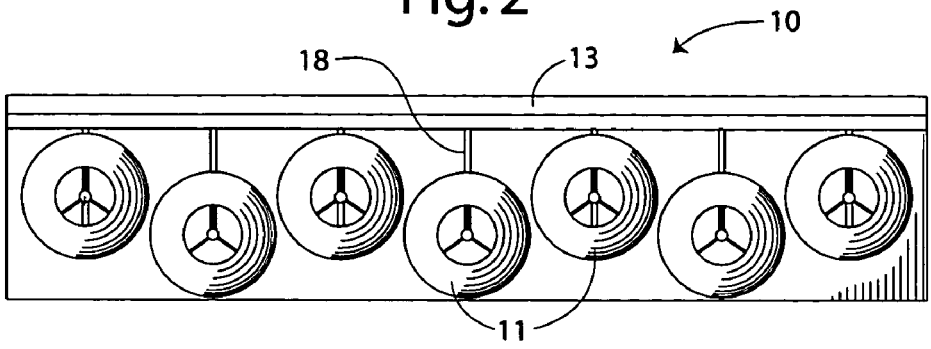
FIG. 2 is a top view of the lamp display system of FIG. 1.
Figure 3:
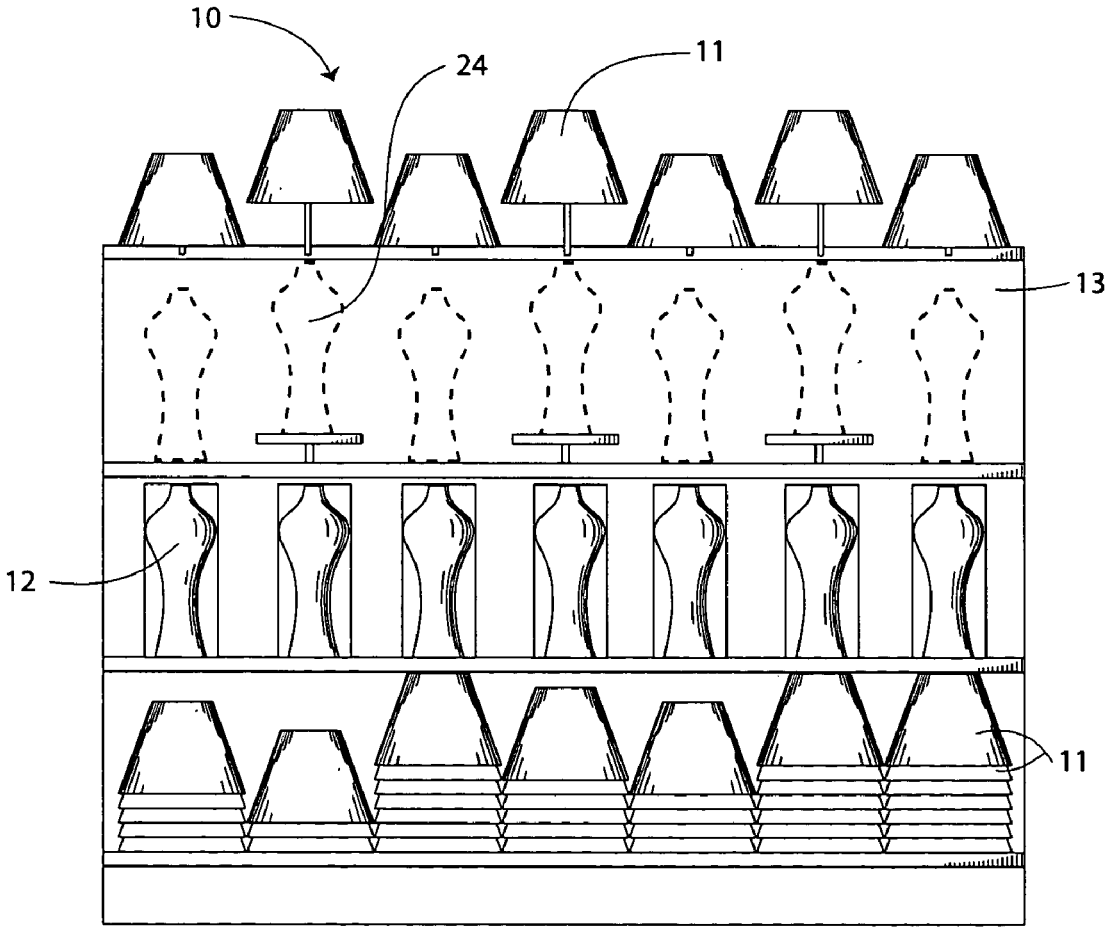
FIG. 3 is a front view of the lamp display system of FIG. 1.
Figure 5:
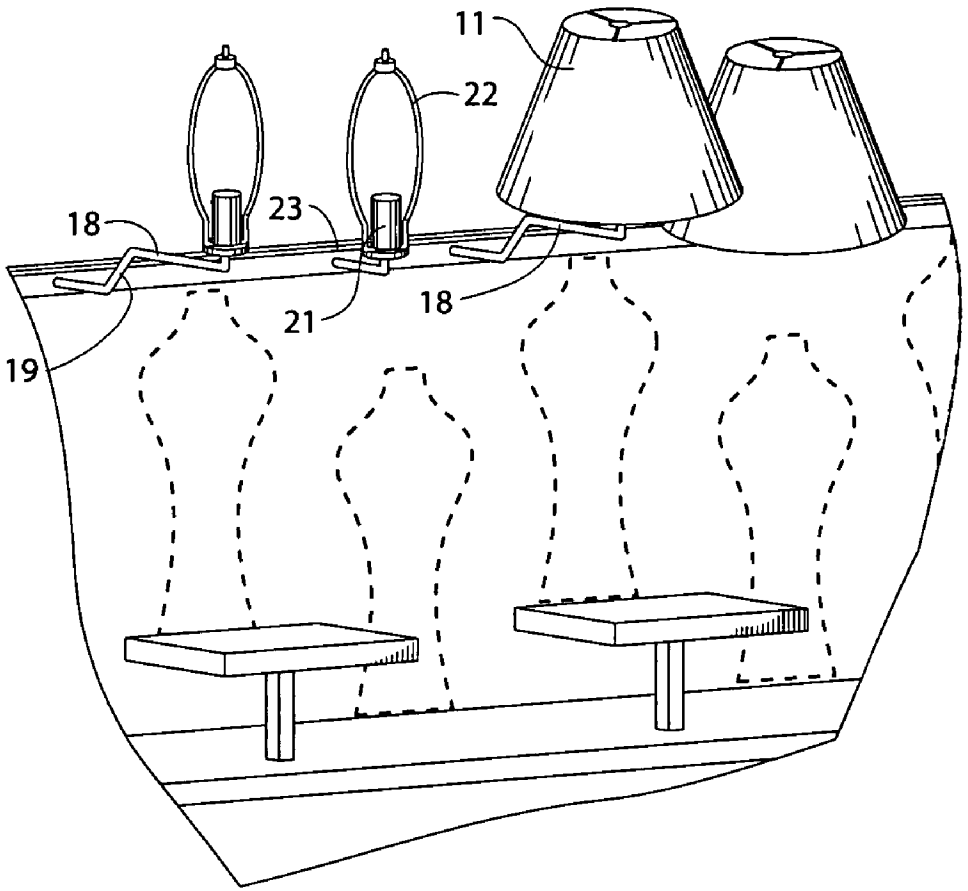
FIG. 5 is a more detailed view of a portion of the lamp display system of FIG. 1.
Figure 4:
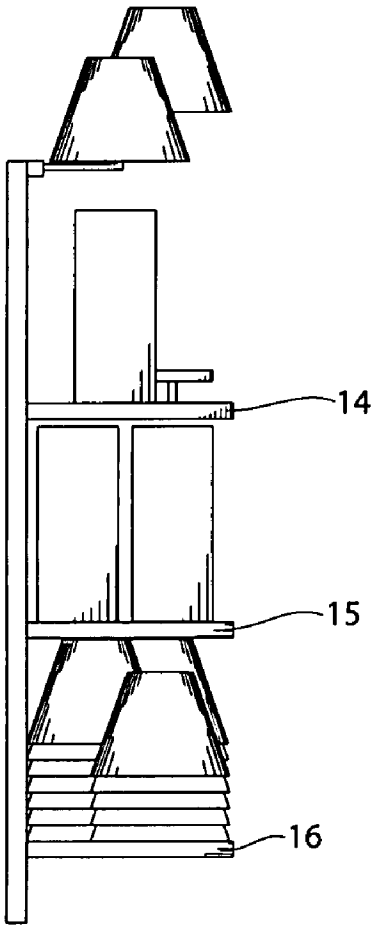
FIG. 4 is a side view of the lamp display system of FIG. 1.

With reference next to the drawings, there is shown a lamp display system 10 for displaying various lamp shades 11 with various lamps 12. The lamp display system 10 includes a generally planar rear wall 13, a top shelf 14 mounted to the rear wall 13, a middle shelf 15 mounted to the rear wall 13, and a bottom shelf 16 mounted to the rear wall 13. The system 10 also includes a plurality of lamp shade mounting arms 18. Each mounting arm 18 has an arm portion 19 extending to a light bulb socket 21, and a harp 22 coupled to the socket 21. It should be understood that the socket 21 and its ancillary electric cord or conduit is optional and may be included only if the display is intended to show that lamp shade in an illuminated condition.

Each mounting arm 18 may be mounted to an elongated mounting bracket 23 which in turn is mounted to the rear wall 13. The mounting arms 18 are also staggered in height and/or distance from the rear wall 13 to allow for the compact display of many lamp shades 11.

The rear wall 13 may also include a silhouette 24 of various lamp configurations to aid the consumer in aligning the lamp 12 to the lamp shade 11. Additionally, small lamp shelves 25 may be mounted to the back wall 13 in alignment with the silhouette to enable the lamp to be placed on the shelf in an elevated position above the top shelf.

In use, the lamp shade mounting arms 18 are mounted in an elevated position above the top shelf 14 and in alignment with the silhouettes 24. The lamps 12 for sale are displayed on the middle shelf 15 while the shades 11 for sale are displayed on the bottom shelf 16, or visa-versa. The shades 11 for sale at the retail location correspond to the shades 11 mounted to the mounting arms 18.

A customer may then selected a desired lamp 12 and position the lamp 12 in alignment with the mounting arm 18 coupled to the shade 11 the customer desires to coordinate with the selected lamp. In this manner, should the customer decide the first selected shade does not have the desired corresponding appearance with the selected lamp that customer may simply move the lamp 12 to the location of the next desired lamp shade. The customer may view the lamp with a lamp shade in the actual location of the lamp shade relative to the lamp base without the necessity of actually mounting the lamp shade to the base. As the customer does not have to actually mounted each selected lamp shade to the selected lamp, multiple lamp shades may be viewed with multiple lamp bases in a quick and efficient manner.

It thus is seen that a lamp display system is now provided which enables a customer to compare different lamps with different lamp shades in an efficient manner. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A lamp display system comprising:

a first shelf configured to support a lamp base; and a plurality of lamp shade mounting arms positioned above said first shelf, each said lamp shade mounting arm being configured to support a lamp shade;

whereby lamp bases may be positioned below the various lamp shades for comparison purposes.

2. The lamp display system of claim 1 further comprising a rear wall to which said first shelf is mounted.

3. The lamp display system of claim 1 further comprising a lamp base silhouette imposed upon said rear wall and below a lamp shade mounting arm.

4. The lamp display system of claim 1 further comprising a second shelf configured to support a plurality of lamp bases.

5. The lamp display system of claim 4 further comprising a third shelf configured to support a plurality of lamp shades.

6. The lamp display system of claim 1 wherein said lamp shade mounting arms include an electrical socket and an electrical conduit coupled to said electrical socket.

7. The lamp display system of claim 1 further comprising an elongated mounting bracket, wherein said lamp shade mounting arms are mounted to said mounting bracket.

8. The lamp display system of claim 1 wherein said lamp display mounting arms are staggered in height above said first shelf.

9. A lamp display system comprising:

a rear wall;

a first shelf coupled to said rear wall and configured to support a lamp base;

a second shelf coupled to said rear wall and configured to support a plurality of lamp bases; and a plurality of lamp shade mounting arms positioned above said first shelf, each said lamp shade mounting arm being configured to support a lamp shade;

whereby lamp bases may be positioned below the various lamp shades for comparison purposes.

10. The lamp display system of claim 9 further comprising a lamp base silhouette imposed upon said rear wall and below a lamp shade mounting arm.

11. The lamp display system of claim 9 wherein said lamp shade mounting arms include an electrical socket and an electrical conduit coupled to said electrical socket.

12. The lamp display system of claim 9 further comprising an elongated mounting bracket, wherein said lamp shade mounting arms are mounted to said mounting bracket.

13. The lamp display system of claim 9 wherein said lamp display mounting arms are staggered in height above said first shelf.

14. The lamp display system of claim 9 further comprising a third shelf coupled to said rear wall and configured to support a plurality of lamp shades.

* * * * *